US005524696A

United States Patent [19]

Osborne et al.

[11] Patent Number: 5,524,696

[45] Date of Patent: Jun. 11, 1996

[54] METHOD OF MAKING A CASTING HAVING AN EMBEDDED PREFORM

[75] Inventors: Richard J. Osborne, Shelby Township; Gregory Sanders, Canton; Lori J. Sullivan, Mt. Clemens, all of Mich.

[73] Assignee: General Motors Corporation, Detroit, Mich.

[21] Appl. No.: 286,568

[22] Filed: Aug. 5, 1994

[51] Int. Cl.[6] ..... B22C 9/04; B22D 19/02

[52] U.S. Cl. ..... 164/34; 164/98; 164/120

[58] Field of Search ..... 164/34, 35, 120, 164/98, 97

[56] References Cited

U.S. PATENT DOCUMENTS

| | | | |
|---|---|---|---|
| 974,024 | 10/1910 | Carter . | |
| 4,243,093 | 1/1981 | Nieman | 164/96 |
| 4,446,906 | 5/1984 | Ackerman et al. | 164/112 |
| 4,559,685 | 12/1985 | Hara et al. | 29/156.5 R |
| 4,633,931 | 1/1987 | Yamaguchi et al. | 164/110 |
| 4,691,754 | 9/1987 | Trumbauer et al. | 164/9 |
| 4,908,923 | 3/1990 | Anderson et al. | 29/888.01 |
| 5,014,764 | 5/1991 | Garat et al. | 164/34 |
| 5,038,847 | 8/1991 | Donahue et al. | 164/112 |
| 5,058,653 | 10/1991 | Garat | 164/120 |
| 5,074,352 | 12/1991 | Suzuki | 164/97 |
| 5,113,925 | 5/1992 | Cook | 164/97 |
| 5,263,533 | 11/1993 | Draschitz et al. . | |
| 5,372,176 | 12/1994 | Brown et al. | 164/34 |

*Primary Examiner* Jack W. Lavinder
*Assistant Examiner* Randolph S. Herrick
*Attorney, Agent, or Firm* Lawrence B. Plant

[57] ABSTRACT

A "lost foam" method of making a casting having a preform embedded at a selective location therein including the steps of: engulfing a porous preform in a fugitive pattern; embedding the pattern in a loose sand mold in a vessel; pouring molten metal into the mold cavity via a sprue and runner system formed in the sand bed so as to destroy the pattern and fill the mold cavity with metal; pressurizing the vessel to force molten metal from the cavity into the porous preform; replacing metal lost from the cavity with make-up metal from the sprue and runner system; allowing the casting to solidify; and removing the casting from the sand bed.

7 Claims, 4 Drawing Sheets

METHOD OF MAKING A CASTING HAVING AN EMBEDDED PREFORM

This invention relates to a "lost-foam" method of forming a casting having a porous preform positioned at a selected location within the casting to enhance the properties of the casting at such location.

BACKGROUND OF THE INVENTION

It is well known in the art to embed porous preforms at selected locations in aluminum castings and to impregnate them with the casting metal to enhance the properties (e.g., strength, wear resistance, creep, stiffness, thermal expansion, etc.) of the casting at such locations. The porous preforms typically comprise ceramic particles/fibers/whiskers bonded together (e.g., sintered) to form a porous body having a desired shape and a porosity of about 50% to about 98% by volume. Typical ceramics used include SiC, $Al_2O_3$, $SiO_2$, $Al_2O_3/SiO_2$ blends and carbon fiber, inter alia. Porous metal preforms may also be used where the melting point of the preform metal is higher than the matrix metal forming the casting and impregnating the preform. In making such castings, the preform is positioned in the appropriate location within a mold cavity and impregnated/infiltrated with the molten metal forced into the cavity under pressure. This is typically accomplished using either the well known "squeeze casting" or "die casting" methods wherein permanent metal molds are used and pressure is applied to the molten metal in the mold cavity near the end of the stroke of a piston in the shot sleeve used to deliver metal to the mold cavity. Supplemental pistons, rods or the like may extend into the mold cavity to apply local pressure to the metal therein during solidification.

The "lost-foam" process is well known in the art and essentially involves (1) forming a pattern from a fugitive material, which pattern mimics the shape of the casting to be made, (2) depositing a porous ceramic/refractory coating on the pattern, (3) embedding the coated pattern in a bed of loose sand so as to define a mold cavity within the sand bed corresponding to the shape of the pattern, and (4) pouring molten metal into the mold cavity so as to destroy (e.g., vaporize) the fugitive pattern and fill the mold cavity left thereby with the metal. The pattern is provided with an extension which defines a sprue and runner system in the loose sand for introducing the metal to the mold cavity. The sprue portion of the extension typically stands higher than the high point of the cavity in order to provide a metallostatic head of metal sufficient to cause the metal to readily advance into the mold cavity and completely displace the fugitive pattern therein.

A commonly used mold pattern comprises a foam made from expanded polystyrene (EPS) beads steam-bonded together in an appropriate mold, which pattern vaporizes and/or liquifies and escapes the mold cavity through the refractory coating into the interstitial voids between the loose sand surrounding the pattern during casting. A metallostatic head of at least about 1 psi (i.e., about 10 inches high) above the high point of the mold cavity is typical for pattern made from EPS. Other fugitive materials useful as patterns for this process include polymethylmethacrylate (PMMA) and polyalkylene carbonate. Typically, porous protective refractory coatings on the pattern comprise silica, mica, and clay binders and serve to improve pattern stiffness, prevent sand erosion, improve casting surface finish, and aid in release of gas and liquid products from foam pyrolysis. The coatings may be applied by spraying or dipping.

Metal impregnated porous preform-containing castings have not heretofore been made using the "lost-foam" process. Accordingly, it is an object of the present invention to provide an improved "lost foam" process specifically adapted to forming castings having porous preforms embedded therein at selective locations thereof and filled with the metal forming the casting. This and other objects and advantages of the present invention will become more readily apparent from the following description thereof.

BRIEF DESCRIPTION OF THE INVENTION

The present invention contemplates a "lost foam" method of making a metal casting having a preform embedded at a selective location in the casting and impregnated with the metal forming the casting. Essentially, the process comprises steps of: engulfing a porous preform in a fugitive pattern which serves to define a mold cavity in a bed of loose sand surrounding the pattern; positioning the pattern containing the preform in a vessel; introducing loose sand into the vessel so as to completely embed the pattern which defines a molding cavity within the loose sand; introducing molten metal into the molding cavity to completely destroy the pattern and displace the pattern in the cavity left in the loose sand bed; and while the metal in the mold cavity is still sufficiently molten and mobile pressurizing the vessel to a pressure sufficient to urge the molten metal surrounding the preform into the interstices of the preform and thereby impregnate the porous preform; and providing make-up metal lost from the mold cavity incident to impregnating the preform and solidification of the casting. The pattern has an extension thereon which defines a channel (i.e., sprues and runners in the bed of sand for admitting molten metal to the cavity. The channel includes a sprue portion for receiving molten metal from a source thereof and a runner portion communicating the sprue with the mold cavity. That portion of the extension which defines the sprue is positioned in the vessel such that at least a portion thereof stands higher than the high point of the pattern itself. Sufficient metal is cast as to fill the mold cavity and the channel with molten metal as well as provide a column of metal in the sprue which (1) stands above the level of the high point of the cavity so as to provide a metallostatic head of metal above such high point which is at least 1 psi, and (2) contains a volume of metal which is equal to at least the sum of the pore volume of the porous preform and the shrinkage volume which occurs in the casting during solidification. In practicing the method of the subject invention with molten aluminum and an EPS foam pattern, the height of the aluminum in the column standing above the high point of the mold cavity is preferably about 14 inches or more in order to insure that there is enough pressure for the aluminum to completely displace the pattern and any residue therefrom (e.g., styrene) in the mold cavity. Metallostatic pressures of at least about 1.3 psi are preferred. During impregnation of the preform, and solidification of the casting, the metallostatic head provides the driving force to move molten metal from the channel into the cavity to compensate for (1) the volume of metal forced into the porous preform, and (2) the volume of metal lost from the casting incident to the shrinkage occurring during solidification. After the casting has solidified, the vessel is depressurized and the casting removed. The vessel containing the sand may itself be a pressure vessel, or preferably a secondary vessel or flask which after filling with sand is placed in a separate pressure chamber.

Preferably, the vessel will be initially (i.e., first few seconds) gradually pressurized. That is to say, the pressurizing gas will be introduced into the vessel at a controlled rate such that the rate at which the pressure rises in the vessel is initially slow enough to allow the pressurizing gas to fill the voids in the sand bed and preclude the molten metal in the cavity from penetrating the loose sand forming the mold cavity, which would otherwise result in a casting having a rough surface and possibly some sand particles trapped therein. In this regard, pressurizing the vessel too rapidly causes too great a pressure differential ($\Delta P$) to occur at the interface between the metal in the cavity and the sand defining the cavity which tends to drive the molten metal into the interstices between the sand particles. By slowly introducing the gas into the vessel and allowing sufficient time for it to permeate the loose sand forming the mold, the pressure differential at the metal-sand interface is not allowed to rise significantly and precludes the aforesaid metal penetration problem. The exact rate at which the pressure is allowed to build is subject to a number of variables including the size and composition of the sand particles, the composition and temperature of the metal, and the maximum pressure to which the vessel is to be subjected. Hence some trial and error is required to determine the precise pressurizing rate for a given metal-sand-system.

In order to keep the preform from shifting within the mold cavity after the fugitive pattern has been driven off, the preforms preferably include anchors projecting therefrom into the loose sand, and serve to hold the preforms in place in the mold cavity as the hot metal drives off and replaces the fugitive pattern.

DETAILED DESCRIPTION OF CERTAIN SPECIFIC EMBODIMENTS OF THE INVENTION

The invention will better be understood when considered in the light of the following detailed description of a specific embodiment thereof which is given hereafter in conjunction with the several drawings in which.

Figure 2:
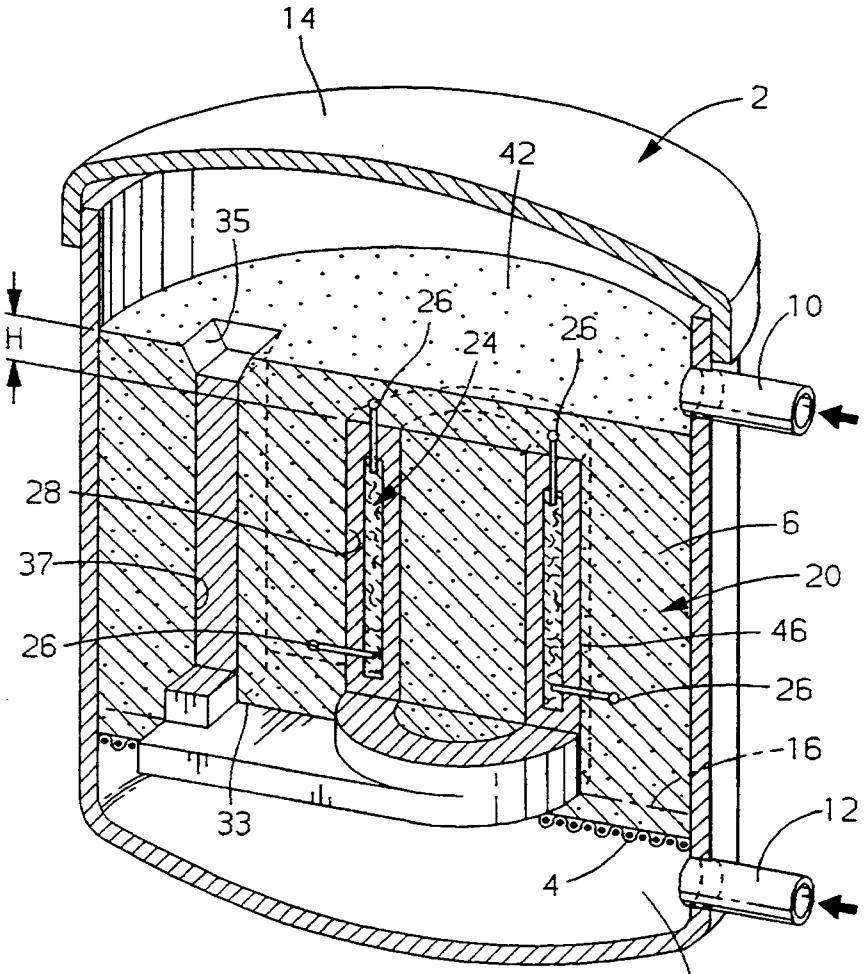
FIGS. 1 and 2 are perspective, sectioned views of one type of apparatus used in the practice of the present invention showing the process at its initial, and final stages respectively.
Figure 1:
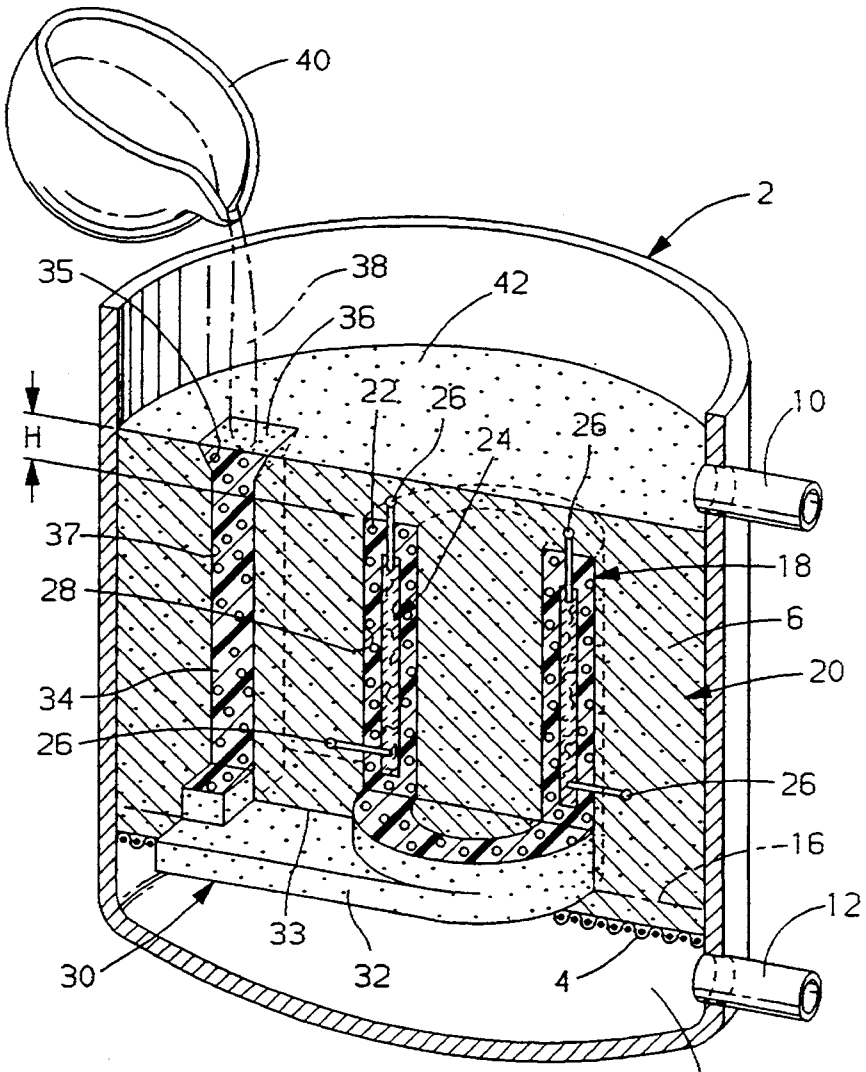

FIGS. 1 and 2 depict a pressure vessel 2 having a fine mesh screen 4 near the bottom thereof dividing the vessel 2 into a sand-retaining section 6 and a gas plenum 8. The mesh of the screen is sufficiently small as to prevent sand 20 deposited thereon from passing therethrough. Gas inlets 10 and 12 are respectively provided near the top of the vessel 2 above the sand 20, and the bottom of the vessel 2 for access to the plenum 8. A cover 14 fits securely atop the vessel 2 for sealing and rendering the vessel 2 pressure tight.

A layer of sand 16 is first laid atop the screen 4, and a fugitive pattern 18 laid atop the layer 16. Thereafter, additional loose sand 20 is dispensed into the vessel 2 so as to completely engulf the pattern 18 along the sides and top thereof. The pattern 18 itself will preferably comprise EPS foam 22 in a variety of shapes depending on the nature of the part being cast. For simplicity, a cylindrical shape is shown in the Figures. Such a cylinder may, for example, comprise the cylinder bore defining the combustion chamber of an internal combustion engine. A porous, cylindrical preform 24 has previously been embedded in the pattern 18 and may comprise a variety of different materials depending on what property of the casting is sought to be enhanced. Hence, for example, the preform might comprise silicon carbide fibers/whiskers, aluminum oxide fibers, graphite fibers, or glass fibers, etc., bonded together into an integral body. Likewise, the preform may comprise a porous metal, such as, for example, the reticulate network describing Katz et al U.S. Pat. No. 3,694,325. Anchoring pins 26 extend from the preform 24 through the foam 22 and into the sand bed 20 and serve to anchor the preform 24 in position in the sand bed 20 so that the preform 24 will not move/shift when the pattern 18 is destroyed and while the molten metal flows into the molding cavity 28 formed by the pattern 18. If the cylinder were destined for use as a combustion chamber cylinder in an engine block, and wear resistance of the inside surface is the property sought to be enhanced, the cylindrical pattern 18 may have an embedded preform 24 comprising a porous silicon carbide body. After the block has been cast, the inside diameter of the cylinder would be machined away sufficiently to expose the aluminum-filled preform 24 on the working surface of the cylinder.

The pattern 18 is provided with a fugitive extension 30 which comprises a runner-forming portion 32 engaging the bottom of the pattern 18 to form runner 33, and an upstanding sprue-forming portion 34 forming a sprue 37 which ends in a pouring-basin-forming portion 36 atop the sprue-forming portion 34 for forming a pouring basin 35 in the sand 20 for receiving molten metal (e.g., aluminum) 38 from a ladle 40. The extension may be formed along with the pattern 18, but will preferably be made separately therefrom and simply glued thereto in accordance with conventional practice for building-up fugitive patterns. The uppermost end of the sprue 37 (i.e., the pouring basin 35) reaches to the upper surface 42 of the sand 20, and stands above the highest point of the mold cavity 28 by a height H.

A silica/mica-based coating (e.g., Styro-Kote 146 PM sold by Acme-Bordon) is applied to the pattern by dipping into a thoroughly mixed slurry thereof, and dried in an oven at 43° C. The dried coating thickness ranges between about 0.2 to about 0.4 mm.

After the pattern 18 and extension 30 have been coated and embedded in the sand 20, molten metal is poured into the basin 35. The hot metal destroys (e.g., vaporizes) the extension 30 and the pattern 18 and completely fills the void left thereby in the loose sand 20. Sufficient metal is poured as to provide a column of metal in the sprue 37 standing above the high point of the cavity 28 by a height H. This column contains enough metal to completely fill the pores in the porous preform 24 as well as make up for any shrinkage that will occur in the casting during solidification thereof. Moreover, the height H of the metal in the column will be such as to establish a metallostatic head above the high point of the mold cavity 28 sufficient to insure complete removal of the fugitive pattern 18. For EPS patterns and aluminum metal, this metallostatic head H should be at least about 1 psi, and preferably, at least about 1.3 psi.

After the molten metal 38 has been poured into the loose sand mold 20 and the cavity 28 completely filled with metal, the vessel 2 is sealed (e.g., by means cover 14), and pressurizing gas (e.g., air) introduced into the inlets 10 and 12 until the pressure in the vessel 2 is sufficiently high as to force molten metal 38 from the mold cavity 28 and surrounding the preform 24 into the pores of the preform 24. The pressure required to substantially completely impregnate the preform will vary with the composition and porosity of the preform 24, as well as the composition and temperature of the metal, but will generally be greater than 100 psi. For preforms comprising fibers or particulate of $Al_2O_3$, $SiO_2$, $Al_2O_3/SiO_2$ blends, SiC, or carbon and having a porosity of 85 volume percent, maximum pressures of about 700 psi are preferred for molten 300 series or 319, 356 aluminum alloys cast at temperatures of about 750° C. Pressures as high as 1500 psi have been used. As the metal moves from the cavity 28 into the preform 24 under the influence of the applied pressure, the level of the metal in the sprue 37 drops as metal from the channel 30 moves into the cavity 28 to replace the metal displaced into the preform 24. Moreover, even after the preform 24 is filled, and the metal 38 used therefor is replenished, additional metal will flow from the channel 30 into the cavity 28 as the metal 38 shrinks. The level of the metal in the sprue 37 standing above the high point of the cavity 28 will drop correspondingly.

Surprisingly, very little gas is entrapped in the preform 24 during impregnation thereof. In this regard, as the metal front moves progressively upwardly into the cavity 28, the high temperature of the molten metal causes the gases in the cavity 28 and preform 24 to expand or rarefy and move into the porous sand 20 ahead of the advancing metal front. Hence, by the time the preform 24 is completely engulfed in the molten metal, the volume (i.e., at ambient temperatures) of the gas that remains in the preform 24 is minimal and has no apparent affect on the finished casting even following heat treatment thereof.

The pressure is maintained until the casting has solidified. It is thereafter removed from the vessel 2, and the metal formed in the runner 33 and sprue 37 removed, and recycled back to the appropriate melting pot or furnace.

As indicated above, the pressurizing gas is preferably initially admitted to the vessel 2 at a sufficiently low rate as to preclude the pressure differential at the interface, e.g., 46, between the metal and the sand 20 from becoming so high as to cause the metal to penetrate the surface of the sand 20 at that interface. Allowing the pressure to build slowly allows sufficient time for the gas to migrate through the porous sand 20 to the interface and thereby preventing such a large pressure differential to occur.

According to an alternative, and preferred technique for practicing the present invention, the preform-containing pattern is first embedded in the sand in a separate, discrete vessel or flask which is then placed in a pressure chamber to effect pressurization thereof.

Figure 3:
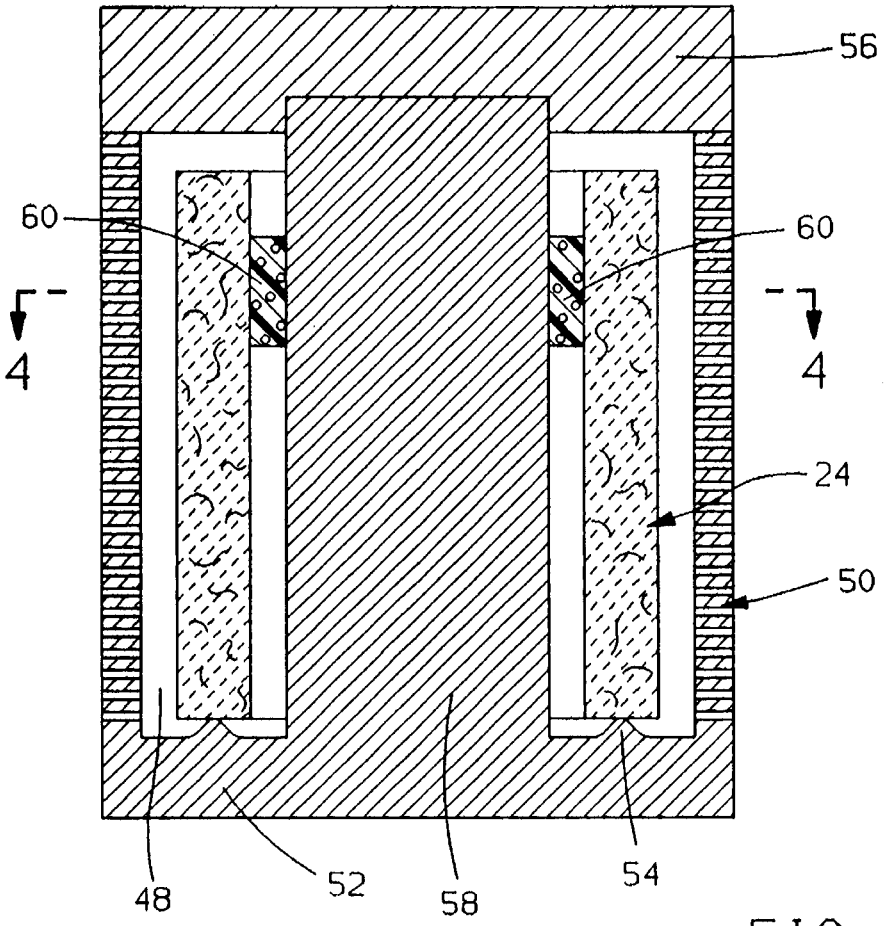
FIG. 3 illustrates, in side sectional view, one technique for preparing preform-containing patterns for use in connection with the present invention.
Figure 4:
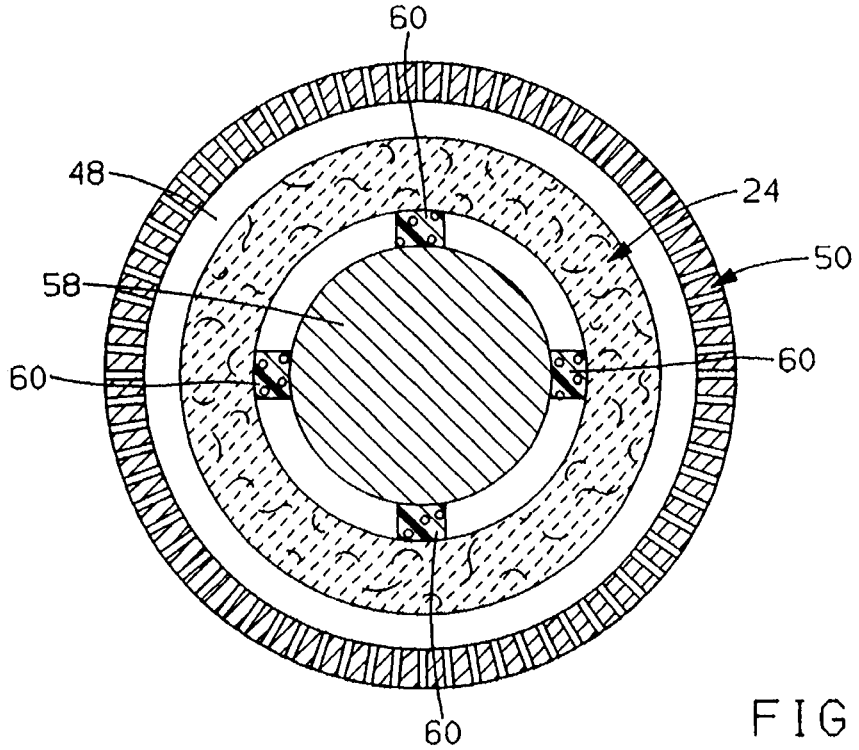
FIG. 4 is a view in the direction 4—4 of FIG. 3.

FIGS. 3 and 4 depict one technique for embedding a porous preform 24 in an EPS pattern 18. The preform 24 is positioned in a cavity 48 of a porous mold 50 (e.g., perforated AL). The preform 24 is spaced from the bottom wall 52 of the mold 50 by an upstanding annular ridge 54 or the like (e.g., spikes). A cover 56 seals off the mold 50 and is spaced above the preform 24 by an appropriate distance dictated by the size/shape requirements of the pattern. The preform 24 is centered in the mold cavity 28, and hence the pattern, by means of a mandrel 58 secured to the bottom wall 52, and spacers 60 which, like the pattern itself, also are comprised of a fugitive material. The spacers 60 will preferably comprise the same composition as the material comprising the fugitive pattern (i.e., EPS). After the preform 24 has been properly positioned in the mold cavity 48 and the cover 56 placed thereon, the fugitive material (not shown) is introduced into the cavity 48 to completely fill all the voids therein. EPS beads, for example, are blown into the cavity 48 under pressure in accordance with conventional practice for making such patterns. Steam is then passed through the porous mold 50 into the EPS beads packed therein for heating and bonding the several beads to each other to form a coherent mass comprising the pattern—all according to conventional lost foam pattern forming practice for steam-bonding such beads.

Figure 5:
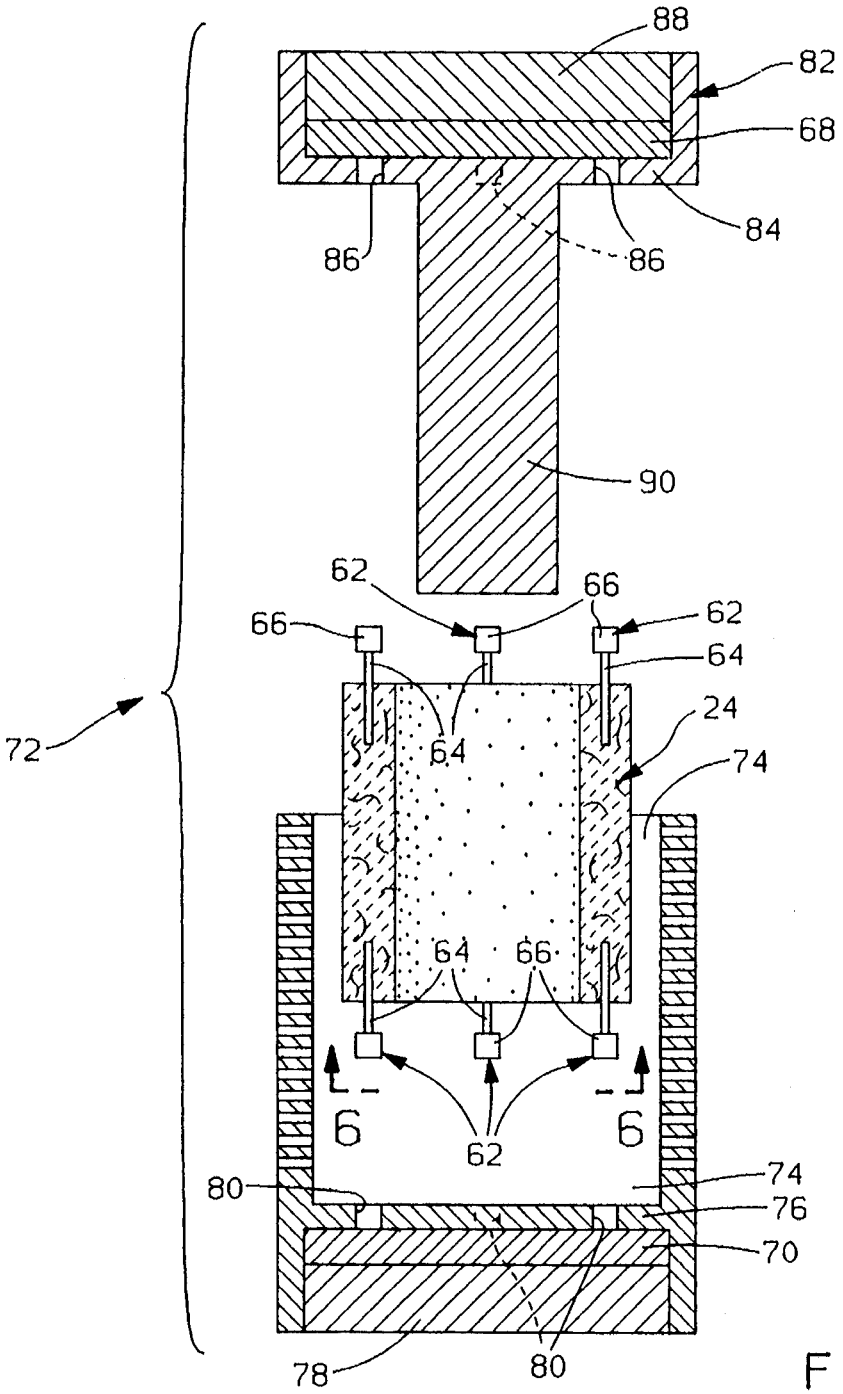
FIG. 5 illustrates, in exploded side sectional view, another technique for making preform-containing patterns for use in connection with the present invention.
Figure 6:
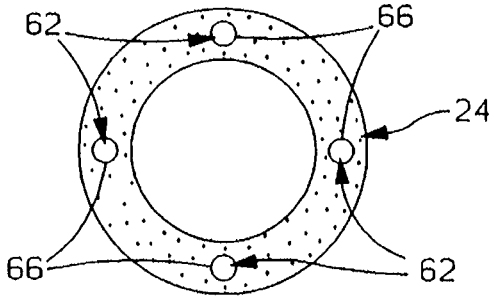
FIG. 6 is a view in the direction 6—6 of FIG. 5.

FIGS. 5 and 6 depict another technique for forming an EPS pattern having a preform therein, and particularly for forming a preform having anchoring pins attached thereto for anchoring the preform in the loose sand mold as discussed above. In this embodiment, the anchoring pins also serve to position the preform 24 in the pattern-forming mold. More particularly, FIGS. 5 and 6 show a porous preform 24 having anchoring pins 62 inserted in the ends thereof. The pins 62 include shank portions 64 embedded in the preform 24, and head portions 66 on the ends of the shank portions 64. The heads 66 will comprise a material which is magnetically attracted to magnets 68 and 70 located in the ends of a porous mold 72. The mold 72 has a mold cavity 74 separated from magnet 70 by a wall 76. A plug 78 permits placement of the magnet 70 adjacent the wall 76 as shown in FIG. 5. Several apertures 80 in the wall 76 register with the heads 66 on the anchors 62 and are adapted to receive the heads 66 of the anchoring pins 62 for positioning and holding the preform 24 in place in the mold cavity 74. Similarly, the mold 72 has a cover 82 which includes a wall 84 having apertures 86 therein which register with the heads 66 on the other end of the preform 24. A plug 88 provides access to the backside of the wall 84 for placement of the magnet 68 thereat. A metal core 90 extends from the cover 82 into the mold cavity 74 for defining the central opening to be formed in the cylindrical pattern produced by this technique. The preform 24 is positioned in the mold cavity 74 such that the heads 66 on the lowermost anchoring pins 62 nest within the apertures 80 and are magnetically held therein by the magnet 70. Similarly, when the cover 82 is placed in position, the heads 66 of the uppermost anchoring pins 62 engage the apertures 86 and are held therein by the magnet 68. Thereafter, the fugitive pattern forming material is introduced into the mold cavity 74. When the pattern material is expanded polystyrene (EPS) beads, they are steam-bonded together as discussed above.

SPECIFIC EXAMPLE

Figure 7:
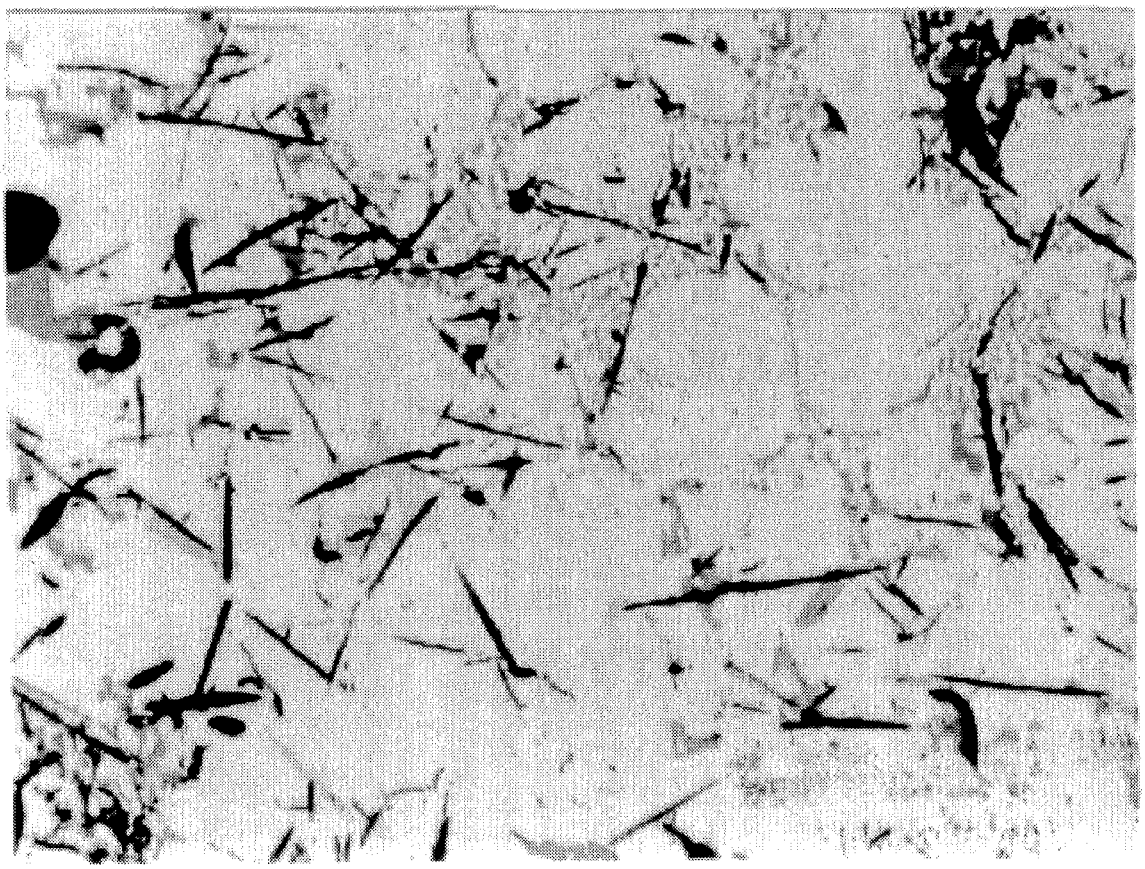
FIG. 7 is a photomicrograph of a casting made in accordance with the present invention.

In accordance with one specific example of the invention, a preform having a total volume of 148.7 $cm^3$, comprising 97% $Al_2O_3$/3% $SiO_2$ sold under the trade name SAFIL and 15 volume percent solids was engulfed in an expanded polystyrene (EPS) pattern. An extension was glued thereto for forming a sprue and runner system for feeding molten metal to the bottom of the pattern during the metal filling operation. The inlet end of the extension, and hence the sprue, stood above the top of the pattern by 12 (30.5 cm) inches. The pattern and extension were coated with a silica, mica-based refractory coating having room temperature permeability of about $0.1\times10^{-3}M^2$/sec. to $0.2\times10^{-3}M^2$/sec. and a thickness of about 0.2 to 0.4 mm by a dipping process as is well known in the art. The coated pattern was then positioned above a metal screen in a pressure vessel and surrounded with silica sand having an average particle size of about AFS Fineness No. 35. Molten 319 aluminum was poured into the pouring basin at the inlet of the sprue at a temperature of 750° C. until the pattern had completely vaporized and metal stood in the sprue to a level of 11.0 (27.9 cm) inches above the top of the pattern. The volume of metal in the column of metal standing in the sprue above the molding cavity was 680 $cm^3$. The vessel was immediately sealed and pressurized with Argon or air to a maximum pressure of 650 psi. The gas was initially slowly introduced to the chamber such that the pressure slowly built up in the vessel at a rate of 1.10 psi/sec. for the first few seconds to about 8.2 psi/sec. after about 4 seconds into the fill. It took a total of 80 seconds to reach maximum pressure. At this pressure, the still molten aluminum infiltrated the preform, and make-up aluminum for that lost to the preform flowed into the cavity from the sprue and runner system. The vessel was held at the elevated pressure until the casting had solidified during which time additional metal flowed from the sprue and runner system into the mold cavity to fill any voids occurring therein incident to shrinkage of the casting during solidification. After the casting had solidified, the pressure in the vessel was reduced to ambient pressure and the casting removed. FIG. 7 is a 200× photomicrograph of the resultant material wherein the dark fibers F are SAFFIL preform and the lighter matrix metal M the 319 aluminum.

Another casting made the same way as set forth above was heat treated to 930° F. for 8 hours to simulate a 319 T6 aluminum solution heat treatment. Another similar sample was heated to 390° F. for 8 hours to simulate a 319 T5 aging heat treatment. Examination of both these heat treated samples showed that no blisters had formed during the heat treatment which is indicative of the fact that no significant amount of air was trapped in the preforms made by this process.

While the invention has been disclosed primarily in terms of specific embodiments thereof it is not intended to be limited thereto but rather only to the extent set forth in the claims which follow.

The embodiments of the invention in which an exclusive property or privilege is claimed are defined as follows:

1. A method of making a metal casting having a porous preform embedded at a selective location therein comprising the steps of:

engulfing said preform in a fugitive pattern which serves to define a cavity in a bed of loose, mold-forming sand surrounding said pattern, said pattern having an extension thereon for defining a channel in the sand for admitting molten metal to said cavity, said channel having a runner portion communicating with said cavity and a sprue portion communicating with said runner portion;

embedding said pattern and said extension in loose sand in a vessel such that said sprue portion stands higher than said cavity;

introducing sufficient molten metal into said channel as to destroy said pattern and extension, fill said cavity, engulf said preform, and provide (1) a column of metal in said sprue portion which stands higher than the cavity so as to provide a metallostatic head of said metal above said cavity of at least about one PSI, and (2) a volume of said metal in said column which is equal to at least the sum of the pore volume of said porous preform and the shrinkage volume of said casting;

while said metal is still molten, pressurizing said vessel to a pressure sufficient to urge the molten metal engulfing the preform into the interstices of the preform and thereby impregnating said porous preform while moving molten metal from said channel into said cavity to compensate for the volume of metal used to impregnate said preform;

allowing said casting to cool while moving molten metal from said channel into said cavity to compensate for the volume of metal lost from the casting due to shrinkage;

depressurizing said vessel; and removing said casting from said vessel.

2. A method according to claim 1 wherein pressurizing gas is introduced into said vessel at a controlled rate such that the rate at which said pressure rises in said vessel during said pressurization is sufficiently slow as to preclude said molten metal in said cavity from penetrating the sand defining said cavity.

3. A method according to claim 1 including the step of providing said preforms with anchors projecting therefrom, and embedding said anchors in said sand to substantially prevent movement of said preform in said cavity during the filling of said cavity with said metal.

4. A method according to claim 1 wherein said metal is aluminum and said column stands at least about one foot above said cavity.

5. A method according to claim 3 wherein said column stands at least fourteen inches above said cavity.

6. A method according to claim 1 wherein said pressure is at least 100 psi.

7. A method according to claim 6 wherein said pressure is initially allowed to rise at a rate no greater than about 1.10 psi/sec.

* * * * *